US008684063B2

(12) United States Patent
Lin

(10) Patent No.: US 8,684,063 B2
(45) Date of Patent: Apr. 1, 2014

(54) WINDOW COVERING HAVING CORD SHROUDS

(75) Inventor: Tzong-Fu Lin, Taipei (TW)

(73) Assignee: Whole Space Industries LTD, Taipei (TW)

( * ) Notice: Subject to any disclaimer, the term of this patent is extended or adjusted under 35 U.S.C. 154(b) by 42 days.

(21) Appl. No.: 13/303,223

(22) Filed: Nov. 23, 2011

(65) Prior Publication Data

US 2013/0126105 A1 May 23, 2013

(51) Int. Cl.
*A47H 5/032* (2006.01)

(52) U.S. Cl.
USPC ..... 160/84.04; 160/84.01; 160/173 R

(58) Field of Classification Search
USPC ..... 160/84.01, 84.04, 84.05, 168.1 R, 173 R, 160/178.3, 178.1 R
See application file for complete search history.

(56) References Cited

U.S. PATENT DOCUMENTS

| | | | | |
|---|---|---|---|---|
| 3,160,202 | A * | 12/1964 | Rosen | 160/344 |
| 4,880,044 | A * | 11/1989 | Judkins | 160/84.04 |
| 4,909,298 | A | 3/1990 | Langhart et al. | |
| 5,495,883 | A | 3/1996 | Jelic | |
| 5,533,559 | A | 7/1996 | Judkins | |
| 5,613,540 | A | 3/1997 | Jelic | |
| 5,630,458 | A | 5/1997 | Holden | |
| 5,743,319 | A * | 4/1998 | Christopherson | 160/173 R |
| 5,769,140 | A * | 6/1998 | Tuzmen | 160/168.1 R |
| 6,431,248 | B1 | 8/2002 | Hyman et al. | |
| 6,484,787 | B1 | 11/2002 | Walters | |
| 6,637,493 | B1 | 10/2003 | Lampers | |
| 6,860,312 | B2 | 3/2005 | Judkins | |
| 6,918,425 | B2 | 7/2005 | Nien | |
| 6,948,546 | B2 | 9/2005 | Nien | |
| 7,000,672 | B2 | 2/2006 | Nien | |
| 7,086,446 | B2 | 8/2006 | Kollman et al. | |
| 7,117,918 | B2 | 10/2006 | Franssen | |
| 7,225,850 | B2 | 6/2007 | McCarty et al. | |
| 7,261,138 | B2 | 8/2007 | Judkins et al. | |
| 7,318,251 | B2 | 1/2008 | Lin | |
| 2005/0092448 | A1 * | 5/2005 | Lin | 160/291 |
| 2006/0144526 | A1 | 7/2006 | McGinley | |
| 2007/0023149 | A1 | 2/2007 | Lamars et al. | |
| 2008/0110581 | A1 | 5/2008 | Lin | |
| 2011/0132555 | A1 * | 6/2011 | Rowley et al. | 160/340 |
| 2011/0209834 | A1 * | 9/2011 | Lowry et al. | 160/84.04 |
| 2012/0227910 | A1 * | 9/2012 | Lin | 160/84.01 |

OTHER PUBLICATIONS

U.S. Appl. No. 13/185,629, filed Jul. 19, 2011.
U.S. Appl. No. 13/214,515, filed Aug. 22, 2011.

* cited by examiner

*Primary Examiner* — Blair M. Johnson
(74) *Attorney, Agent, or Firm* — Buchanan Ingersoll & Rooney PC

(57) ABSTRACT

A window covering includes a plurality of cord shrouds for enclosing or covering lift cords. Each of the cord shrouds may be continuously attached to the window covering material via a continuous attachment mechanism that includes one or more columns of stitching, beads of adhesive or welding. The cord shrouds may prevent the lift cords from being pulled away from the window covering material to form loops that could pose a danger to a young child. Embodiments of the window covering may be configured as top down bottom up shades or other types of shades. The window covering material may be composed of any of a number of different materials. For example, the window covering material could include pleated material, or could be comprised of a sheet of material consisting of woven wood, interconnected fabric segments, non woven fabric or woven fabric.

19 Claims, 7 Drawing Sheets

WINDOW COVERING HAVING CORD SHROUDS

FIELD OF INVENTION

The present invention relates to window coverings such as pleated shades, Venetian blinds, and other types of shades or blinds.

BACKGROUND OF THE INVENTION

On occasion, children have been able to get behind a lowered Roman shade, pull a lift cord to form a loop and become entangled in the loop. If the lift cord is around the child's neck and the child falls, the cord could act as a noose and strangle the child. Children have also become entangled within lift cords of venetian blinds. Reports of such incidents have prompted at least one major retailer to issue a recall of one product line of Roman shades and the United States Consumer Product Safety Commission (CPSC) has issued a warning about the danger of child entanglement with cords of window coverings. In addition the CPSC has issued guidelines, rules and proposed rules that require window covering manufacturers to make shades with inaccessible cords or to construct the window covering product in a manner so that a child cannot form a loop in a cord which is large enough, greater than 8 inches in diameter, for a child's head to fit through the loop.

The art has developed various types of child safety devices that are intended to prevent deaths of children who become entangled in lift cords. For instance, U.S. Pat. Nos. 7,318,251, 7,261,138, 7,225,850, 7,117,918, 7,086,446, 7,000,672, 6,948,546, 6,918,425, 6,860,312, 6,637,493, 6,484,787, 6,431,248, 5,630,458, 5,533,559 and 4,909,298 and U.S. Patent Application Publication Nos. 2008/0110581, 2007/0023149 and 2006/0144526 disclose child safety devices for blinds. U.S. Pat. Nos. 5,495,883 and 5,613,540 discloses cord shrouds used on the front of a blind. Child safety devices may be configured to keep the lift cords taut so that the cords cannot be pulled away from the window covering material and form a noose or release the cord from the shade when a child becomes entangled in the shade.

Other examples of child safety devices may be appreciated from my U.S. patent application Ser. No. 13/185,629, which was filed on Jul. 19, 2011, and Ser. No. 13/214,515, which was filed on Aug. 22, 2011. These applications disclose shrouds that may be used in connection with window coverings such as Roman shades, pleated shades, Venetian blinds, and other window coverings with cords.

A new window covering is needed to replace or change conventional blind designs to help prevent the entanglement of children within exposed cords. Preferably, such a design prevents loops from being formed in the lift cords such that children cannot become entangled with lift cords while also covering or enclosing lift cords of the blind.

SUMMARY OF THE INVENTION

A window covering includes an upper rail, window covering material adjacent the upper rail and a plurality of lift cords that extend from the upper rail to position adjacent a lower portion of the window covering material. The window covering material is moveable from a lowered, or extended, position to a raised, or retracted, position. The window covering also includes cord shrouds. Each cord shroud extends from adjacent the upper rail to a position adjacent the lower portion of the window covering material to cover at least one of the lift cords. Each of the cord shrouds is bonded to the window covering material along at least one line extending from adjacent an upper portion of the window covering material to adjacent the lower portion of the window covering material.

It is contemplated that the bonding of each cord shroud to the window covering material may be formed in many different ways. For instance, each cord shroud may be welded, stitched, or adhered to the window covering material. A bead of adhesive, a joint formed via welding, or line of stitching may form the line that extends along the window covering material to form the bond between the cord shroud and the window covering material.

The window covering may be a top down bottom up shade. For such embodiments, the window covering may include a headrail and the upper rail may be a middle rail. A bottom rail may be attached to at least one of the lift cords and the lower portion of the window covering material for such embodiments. Alternatively the window covering may be configured as a shade or blind and the upper rail may be a headrail.

The window covering material may be pleated material and the lift cords may pass through the window covering material. Alternatively, the lift cords may pass along the rear side of the pleated material without passing through the window covering material. Of course, the window covering material may be other types of material suitable for window coverings in alternative embodiments.

The cord shrouds may have any of a number of different structural configurations. For example, the cord shrouds may have a tubular shape or structure and enclose a lift cord within a central channel defined within that structure. As another example, each cord shroud may be a strip of material, such as mesh material. Corresponding sets of cord shrouds may cover respective sides of one or more lift cords for enclosing the lift cord in conjunction with the window covering material to which the cord shrouds are attached.

As may be understood by those of at least ordinary skill in the art, embodiments of the window covering may include one or more lift cord control mechanisms for controlling the positioning of the window covering material. The lift cord control mechanism may be in the upper rail or may be in a bottom rail attached to the window covering material. The lift cord control mechanism may include a spring motor or a motor unit. In yet other embodiments, the lift cord control mechanism may include a cord lock. For such an alternative embodiment, portions of the lift cords could be wound and unwound from a rotatable shaft positioned in the upper rail and pass through the cord lock.

Other details, objects, and advantages of the invention will become apparent as the following description of certain present preferred embodiments thereof and certain present preferred methods of practicing the same proceeds.

BRIEF DESCRIPTION OF THE DRAWINGS

Present preferred embodiments of window coverings are shown in the accompanying drawings and certain present preferred methods of practicing the same are also illustrated therein. It should be appreciated that like reference numbers used in the drawings may identify like components.

DETAILED DESCRIPTION OF PRESENT PREFERRED EMBODIMENTS

Figure 1:
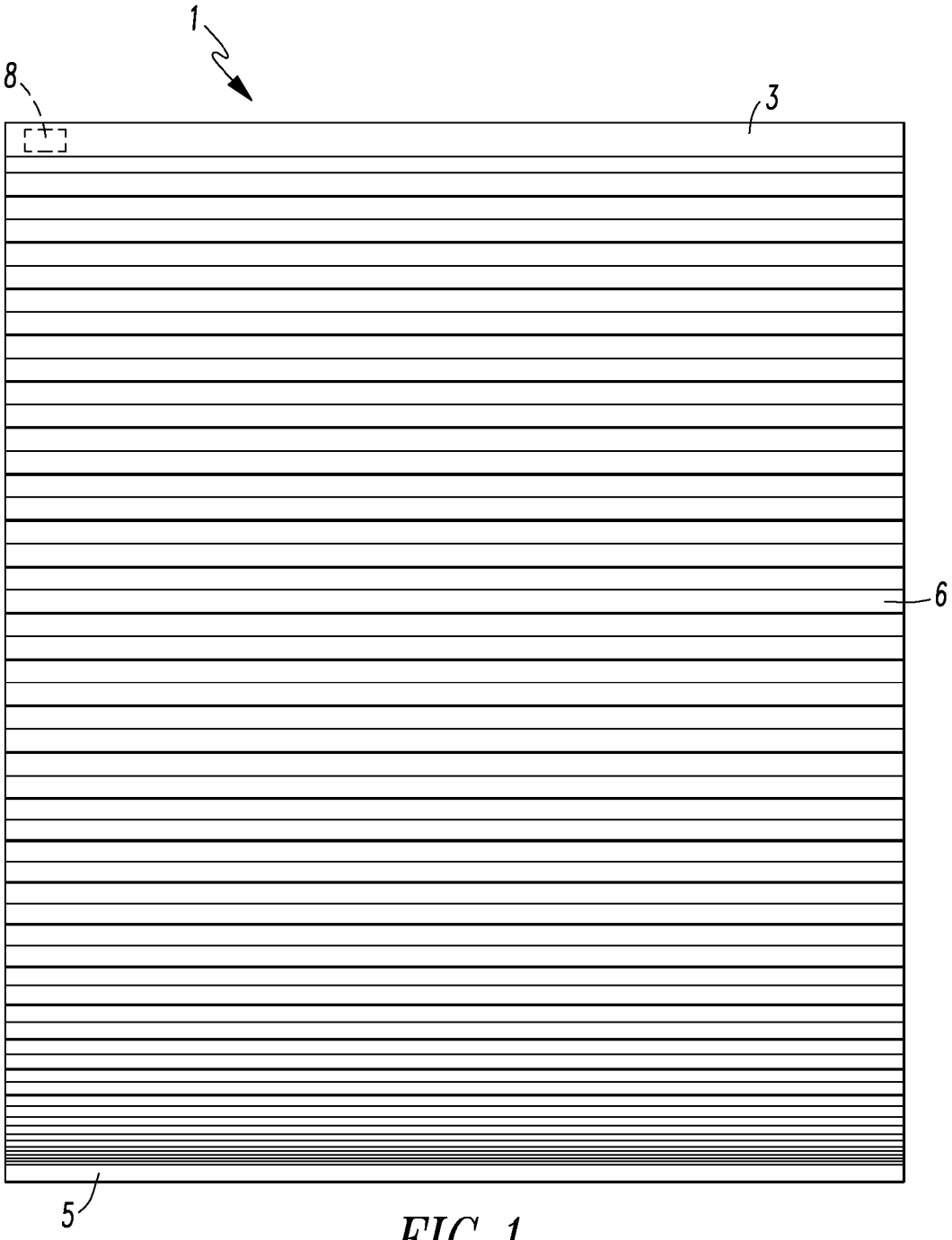
FIG. 1 is a front view of a first present preferred embodiment of the window covering.
Figure 2:
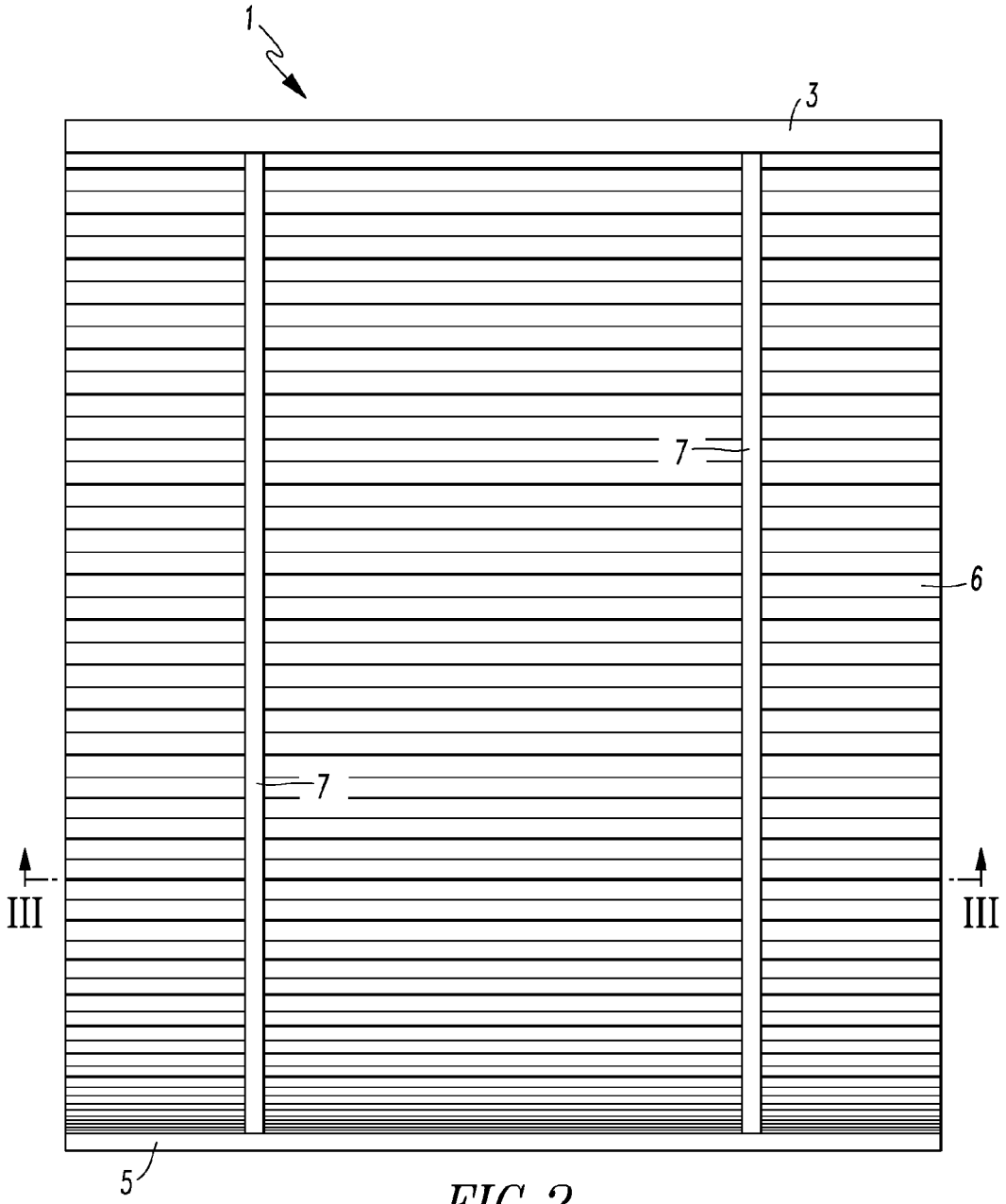
FIG. 2 is a rear view of the first present preferred embodiment of the window covering.

Referring to FIGS. 1-4, a window covering 1 includes an upper rail 3, a bottom rail 5, and window covering material 6 positioned between the upper rail 3 and bottom rail 5. The window covering material may have a top edge attached to the upper rail and a bottom edge attached to the bottom rail 5. Alternatively, the window covering material may be connected to the upper rail or bottom rail by lift cords 11 that pass from a lift cord control mechanism 8 positioned in the upper rail 3 to adjacent a lower portion of the window covering material or the bottom rail 5. In alternative embodiments, the lift cord control mechanism may be positioned in the bottom rail 5 and have lift cords that pass from the bottom rail to the upper rail. As may be appreciated from FIG. 4, the lift cords may pass adjacent to the rear side of the window covering material without passing through the window covering material.

The lift cords may be cords, relatively narrow strips of material or tape that extend from the lift cord control mechanism. The lift cord control mechanism 8 may be a spring motor unit, a motor, or may alternatively include a cord lock. If a cord lock is used, portions of the lift cords may pass through the cord lock.

In some alternative embodiments, the lift cord control mechanism may also include a shaft about which the lift cords are wound that is rotated to extend or retract the lift cords for adjusting the position of the window covering material. In some alternative embodiments, the shaft may be connected to a motor unit or spring motor unit. In other alternative embodiments, the lift cords may be wound about the shaft and may then pass through a cord lock.

The window covering material 6 may be pleated material such that the window covering 1 is a pleated shade or may alternatively be comprised of interconnected fabrics, woven wood material, a film, woven bamboo, woven grass, non-woven fabric, woven fabric, or a sheet of material. It is also contemplated that the window covering material 6 could be slats on ladders such that the window covering would be configured as a Venetian blind.

Cord shrouds 7 may extend along at least one side of the window covering material 6. For example, cord shrouds 7 may be positioned adjacent the rear side of the window covering material and may be continuously attached from the top of the window covering material to the bottom of the window covering material 6 via a bonding 13. Each cord shroud 7 may be bonded to the window covering material for providing a continuous attachment of the cord shroud throughout a substantial length of the cord shroud, which may be a majority of the length of the cord shroud or the entire length of the cord shroud. The bonding 13 may extend along at least one line from adjacent the top of the window covering material to adjacent the bottom of the window covering material.

Figure 3:
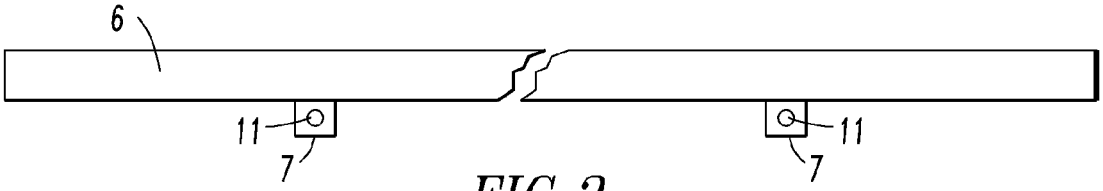
FIG. 3 is a cross sectional view of the first present preferred embodiment taken along line III-III in FIG. 2.
Figure 4:
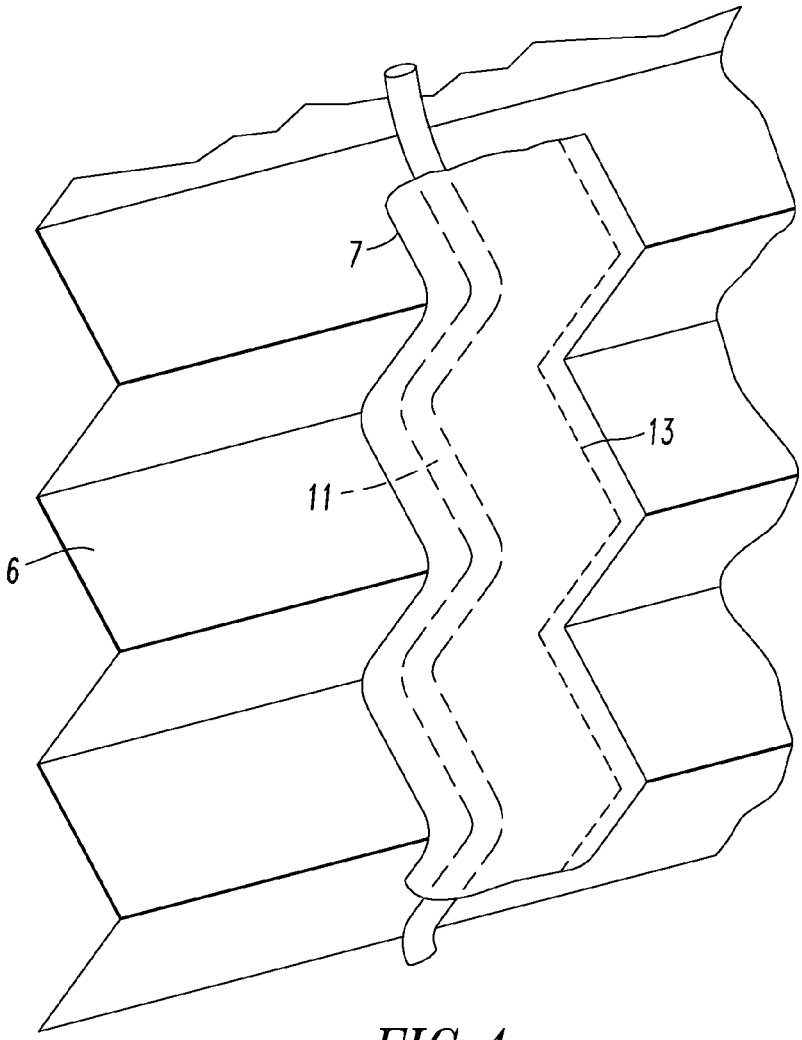
FIG. 4 is a rear fragmentary perspective view of the first present preferred embodiment. A portion of the cord shroud is cut away in FIG. 4 to illustrate a lift cord enclosed within the cord shroud.

As may be best seen in FIG. 3, the cord shroud 7 may have a tubular structure and enclose a lift cord within the inner channel defined by the tubular structure. As may best be seen in FIG. 4, the bonding 13 may only include one column of stitching or may alternatively include multiple columns of stitching for attaching each cord shroud to the window covering material 6. Alternatively, the bonding 13 may be formed by one or more beads of adhesive, or one or more lines of welded joints formed by welding the cord shroud to the window covering material.

As may be appreciated from FIGS. 5-8, alternative embodiments may utilize corresponding sets of cord shrouds for covering the lift cords that pass through the window covering material 6 to enclose the lift cords between the corresponding sets of cord shrouds 7 and the window covering material 6. Such embodiments may permit the cord shrouds to be formed by simple structured shrouds, such as relatively long strips of material that have a width of two to four inches. The material of the cord shrouds may be transparent, white, or a color that matches the color of the window covering material so that the cord shroud is not easily seen by a user while still providing the function of enclosing the lift cords and preventing a small child from holding or pulling the lift cords for forming loops that could pose a strangulation risk or other danger. Alternatively, the cord shrouds may have a different color or a decorative pattern formed thereon to provide a desired aesthetic effect to the window covering material.

Figure 5:
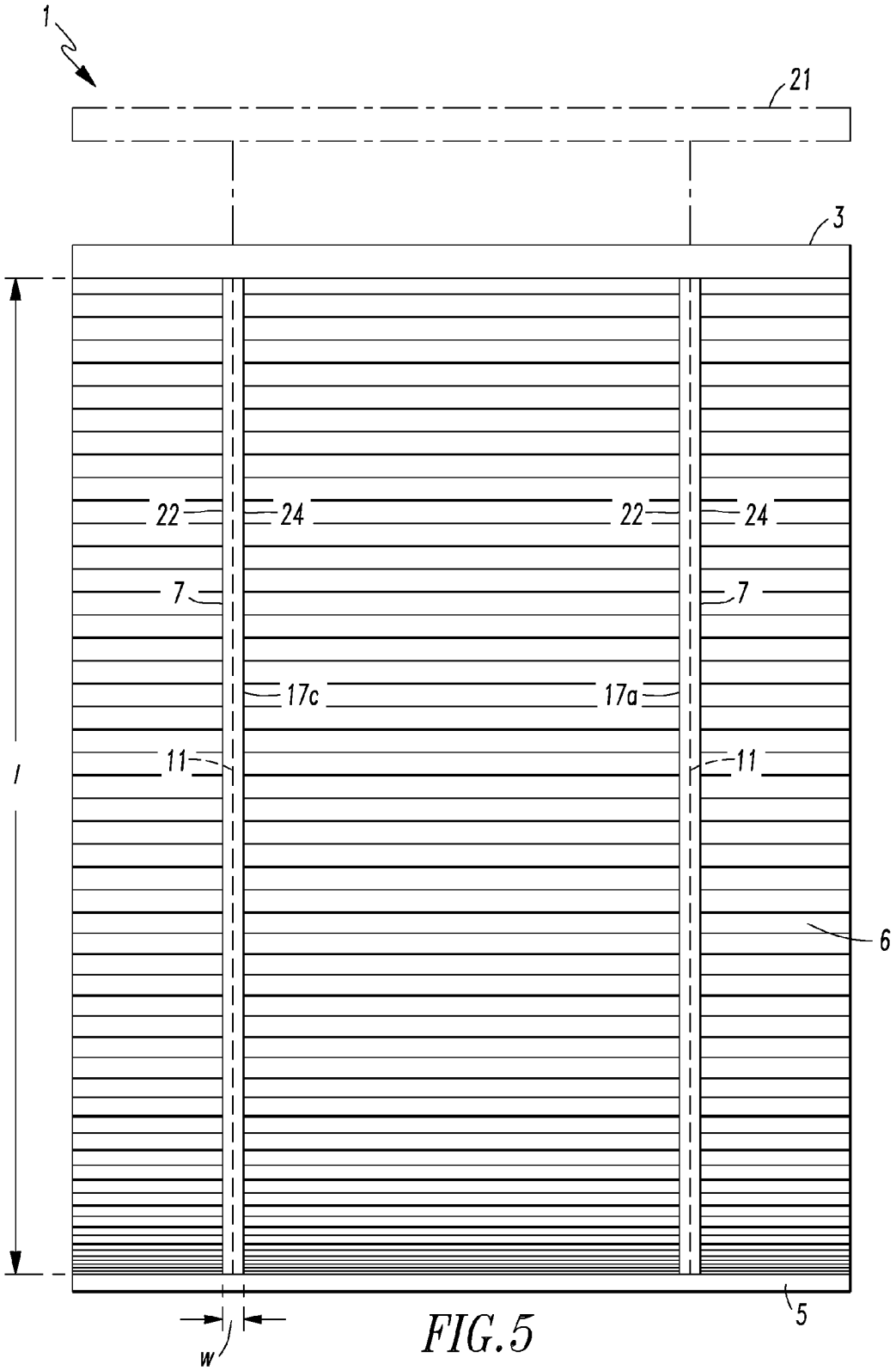
FIG. 5 is a front view of a second present preferred embodiment of the window covering.
Figure 6:
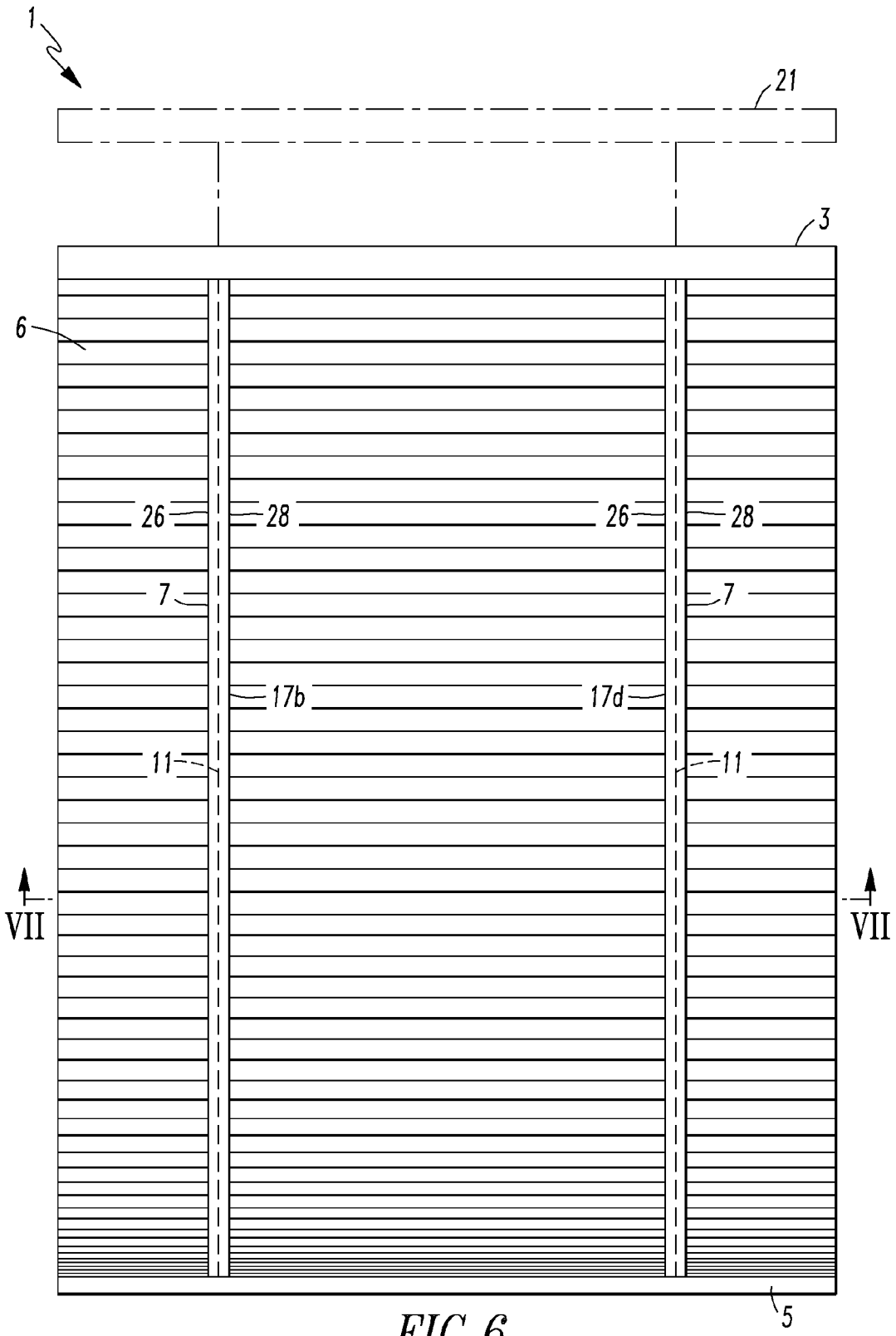
FIG. 6 is a rear view of the second present preferred embodiment of the window covering.

As shown in FIG. 5, a first cord shroud 17*a* may cover a first lift cord adjacent a front side of the window covering material and a corresponding second cord shroud 17*b* shown in FIG. 6 located on the rear side of the window covering material may be positioned to also cover the first lift cord. The first and second cord shrouds 17*a* and 17*b* and window covering material 6 may enclose the first lift cord. The cord shrouds 17*a* and 17*b* may be configured as strips of mesh material such as mosquito netting or other types of mesh material that has a width w. The first cord shroud may have a first side 22 and a second side 24 opposite the first side that extends from the top to the bottom of the first cord shroud. The second cord shroud 17*b* may similarly have a first side 26 and a second side 28 opposite the first side that extends from the top to the bottom of the second cord shroud. As may best be seen in FIG. 8, each side 22, 24 or 26, 28 of the cord shrouds 17*a*, 17*b*, may include a bond 13 that extends along at least one line extending from adjacent the top of the window covering material 6 to adjacent the bottom of the window covering material 6 to attach the opposite sides of the first and second cord shrouds 17*a*, 17*b* to the window covering material 6. Stitching, a joint formed via welding, or a bead of adhesive may extend along the one or more lines on opposite sides of the cord shrouds to form such a bond.

A second lift cord may be covered by a third cord shroud 17*c* positioned on the front side of the window covering material 6 and may also be covered by a corresponding fourth cord shroud 17*d* positioned on the rear side of the window covering material 6 to enclose a second lift cord by the window covering material 6, and the third and fourth cord shrouds 17*c* and 17*d*. The cord shrouds 17*c* and 17*d* may be configured as strips of mesh material such as mosquito netting or other types of mesh material that has a width. Opposite sides of each cord shroud may be bonded to the window covering material for providing a continuous attachment of the cord shroud throughout the length 1 of the cord shroud to the window covering material via stitching, beads of adhesive, or welding. The bonding 13 may be a continuous line extending from adjacent the top of the window covering material to adjacent the lower portion of the window covering material. The bonding 13 on each side of the third and fourth cord shrouds 17*c* and 17*d* may be formed by one or more lines of stitching, at least one bead of adhesive, or at least one joint formed by welding the cord shroud to the window covering material.

Figure 7:
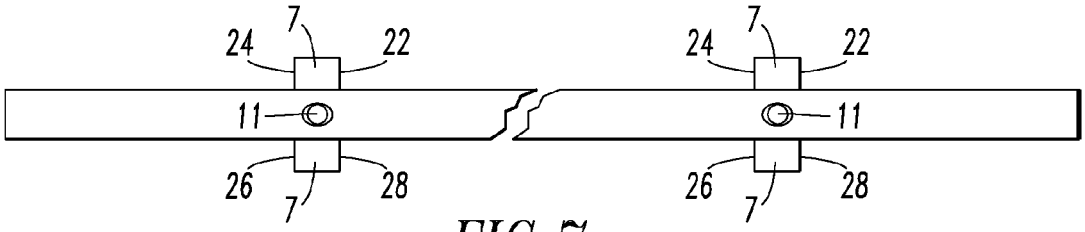
FIG. 7 is a cross sectional view of the second present preferred embodiment taken along line VII-VII in FIG. 6.
Figure 8:
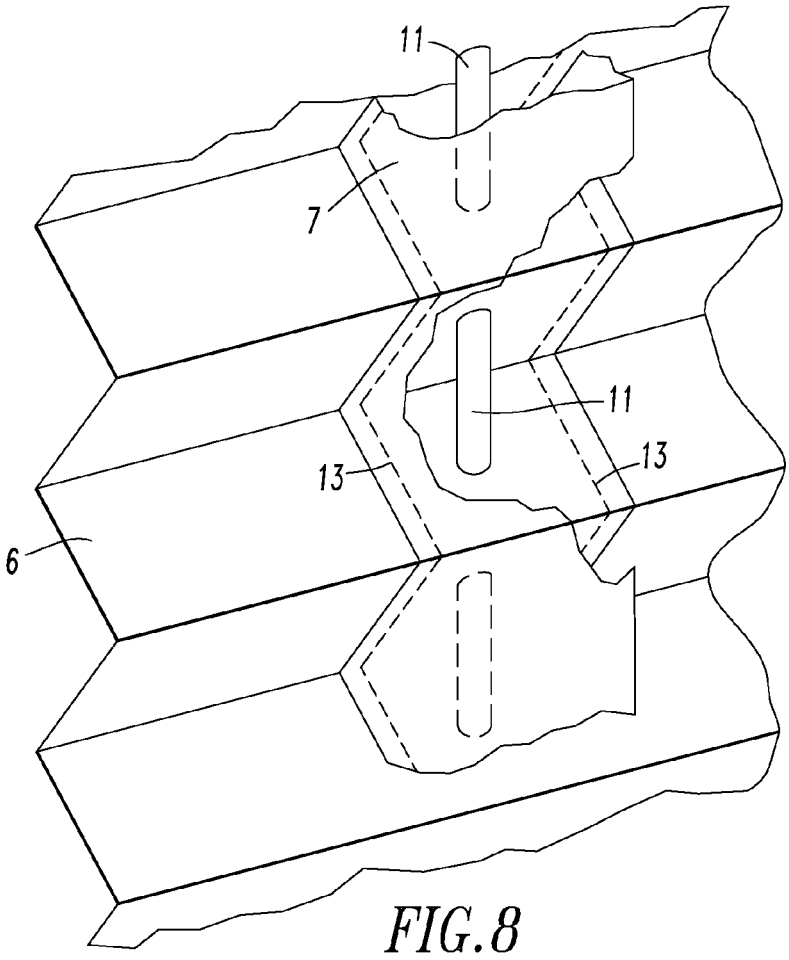
FIG. 8 is a rear fragmentary perspective view of the second present preferred embodiment. A portion of the cord shroud is cut away in FIG. 8 to illustrate the lift cord covered by the cord shroud. It should be appreciated that a corresponding front fragmentary perspective view of the second present preferred embodiment would appear similarly to the rear view shown in FIG. 8.

As may be best appreciated from FIG. 7, it should be appreciated that the first and second cord shrouds 17*a*, 17*b* are a corresponding set of cord shrouds that cover the front and rear sides of the cord, respectively. The first and second cord shrouds 17*a*, 17*b*, in connection with the window covering material, function to enclose the lift cord covered by those cord shrouds 17*a*, 17*b*. The first and second cord shrouds 17*a*, 17*b* bonded to the window covering material may be considered to sandwich the lift cord for enclosing the lift cord therebetween. Similarly, the third and fourth cord shrouds 17*c*, 17*d* are a corresponding set of cord shrouds that cover the front and rear sides of the lift cord, respectively, and function to enclose the covered lift cord in conjunction with the window covering material.

The top and bottom of each cord shroud may not include a connection that passes along the entire width w of each cord shroud. However, it is contemplated that the top and bottom of each cord shroud could also be directly attached to the window covering material so long as a lift cord is permitted to pass into the shroud for raising and lowering the window covering material.

Figure 9:
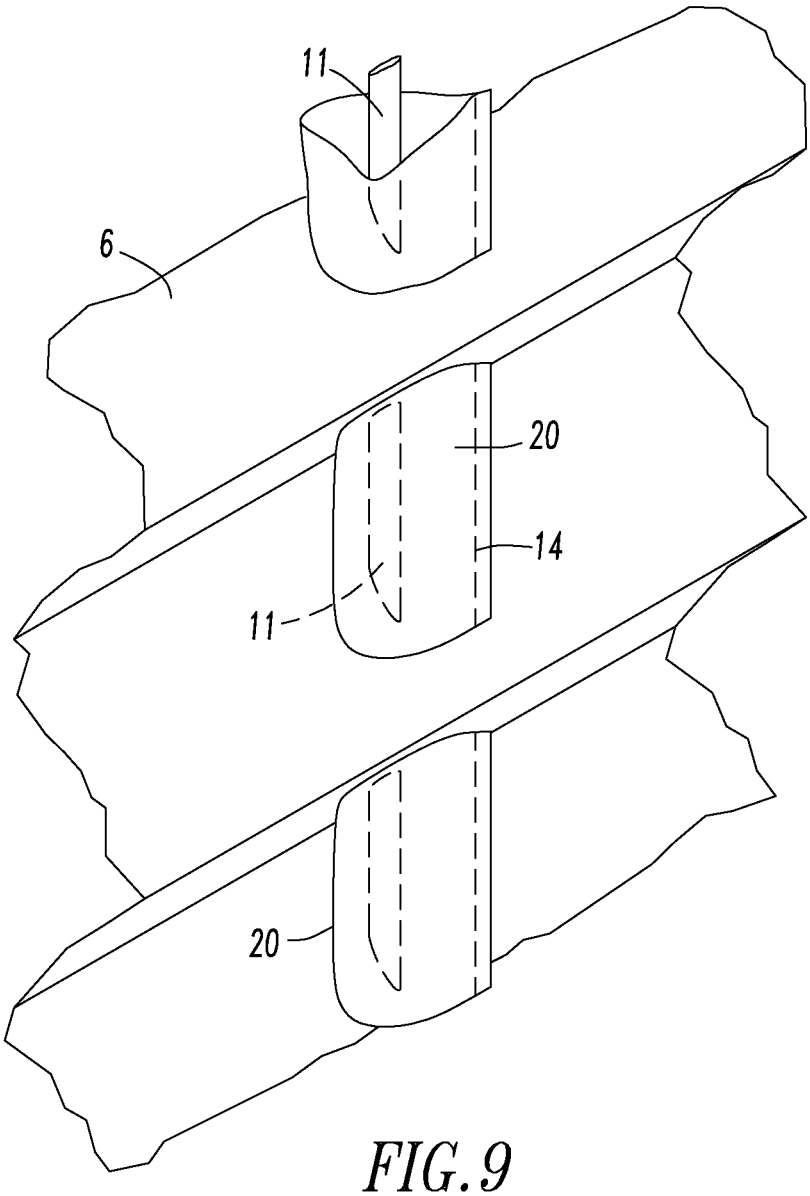
FIG. 9 is a rear fragmentary view of a third embodiment of the window covering. A portion of the cord shroud is cut away in FIG. 9 to illustrate the lift cord enclosed by the cord shroud.

As may be seen in FIG. 9, alternative embodiments of the window covering may include a cord shroud 7 that is formed by a strip of material 20 having two opposite free edges positioned on opposite sides of the window covering material pass through holes in the window covering material along with a lift cord and subsequently stitching 14 the free edges to the window covering material via one line of stitching 14 such that the formed shroud encloses the lift cord. The one line of stitching may attached both free edges of the strip of material 20 to the window covering material such that the cord shroud is present on both the front and rear sides of the window covering material while also passing through the window covering material with the lift cord enclosed therein. It is contemplated that passing the strip of material 20 along with the lift cord through holes in the window covering material to form the cord shroud 7 and fabricate embodiments of such a window covering as shown in FIG. 9 may be difficult to accomplish for making the window covering and could also result in a bunching of portions of the cord shroud and consequently provide a less desirable aesthetic effect as compared to other embodiments of the window covering.

It should be appreciated that embodiments of the window covering may be configured as top down bottom up shades. The upper rail 3 may be a middle rail that is attached to a headrail 21, as may be seen in dotted line in FIG. 4. The headrail 21 may then have a lift cord control mechanism (not shown) for controlling movement of the bottom rail and may have an upper rail control mechanism (not shown) for controlling movement of the upper rail 3. As may be appreciated by those of at least ordinary skill in the art, the upper rail control mechanism may include cords that pass from the headrail 21 to the upper rail that extend or retract from the headrail 21 via a spring motor unit, motor, cord lock, or other cord control mechanism that may be positioned in the headrail 21. Of course, alternative embodiments of the window covering that are configured as shades or blinds may be configured so that the upper rail 3 is the headrail of the blind or shade.

While certain present preferred embodiments of the window covering and certain embodiments of methods of practicing the same have been shown and described, it is to be distinctly understood that the invention is not limited thereto but may be otherwise variously embodied and practiced within the scope of the following claims.

I claim:

1. A window covering comprising:

an upper rail;

window covering material adjacent the upper rail, the window covering material moveable from a retracted position to an extended position;

a plurality of lift cords extending from the upper rail to a position adjacent a lower portion of the window covering material;

a plurality of cord shrouds, each of the cord shrouds extending from adjacent the upper rail to a position adjacent the lower portion of the window covering material to cover at least one of the lift cords, each of the cord shrouds being bonded to the window covering material along at least one line extending from adjacent an upper portion of the window covering material to adjacent the lower portion of the window covering material;

wherein the lift cords comprise a first lift cord and a second lift cord and the cord shrouds comprise a first cord shroud, a second cord shroud, a third cord shroud and a fourth cord shroud, wherein the window covering material has a top and a bottom and a front side and a rear side; and wherein the first cord shroud is attached to the front side of the window covering material and the second cord shroud is attached to the front side of the window covering material; and wherein the third cord shroud is attached to the rear side of the window covering material and the fourth cord shroud is attached to the rear side of the window covering material;

the first cord shroud and third cord shroud covering the first lift cord such that the first lift cord is enclosed by the window covering material, the first cord shroud and the third cord shroud; and the second cord shroud and the fourth cord shroud covering the second lift cord such that the second lift cord is enclosed by the window covering material, the second cord shroud and the fourth cord shroud.

2. The window covering of claim 1 wherein the bonding comprises at least one line of stitching and each of the cord shrouds are attached to the window covering material via stitching sewing the cord shroud to the window covering material.

3. The window covering of claim 1 wherein the upper rail is a headrail or the upper rail is a middle rail.

4. The window covering of claim 3 further comprising a bottom rail attached to at least one of the window covering material and the at least one lift cord adjacent the lower portion of the window covering material.

5. The window covering of claim 1 wherein the window covering material is pleated material and wherein the lift cords pass through the pleated material.

6. The window covering of claim 1 wherein the window covering material is pleated material and has a front side and a rear side and wherein the lift cords pass adjacent to the rear side of the window covering material and wherein the cord shrouds are attached to only the rear side of the window covering material.

7. The window covering of claim 1 wherein the window covering material has a top and a bottom and wherein each of the cord shrouds is bonded to the window covering material along at least one line extending from adjacent an upper portion of the window covering material to adjacent the lower portion of the window covering material via a continuous attachment mechanism that extends from the top of the window covering material to the bottom of the window covering material.

8. The window covering of claim 1 wherein each of the cord shrouds is comprised of mesh material.

9. The window covering of claim 8 wherein the mesh material is mosquito netting.

10. The window covering of claim 1 wherein each of the cord shrouds is tubular shaped.

11. The window covering of claim 1 wherein each of the cord shrouds is bonded to the window covering via at least one continuous bead of adhesive, the at least one continuous bead of adhesive defining the at least one line that extends from adjacent the upper portion of the window covering material to adjacent the lower portion of the window covering material used for forming the bond between the cord shrouds and the window covering material.

12. The window covering of claim 1 wherein the window covering material is comprised of non-woven fabric, woven fabric, interconnected fabric segments, pleated material, or at least one sheet of material.

13. The window covering of claim 1 further comprising a lift cord control mechanism attached to the upper rail.

14. The window covering of claim 12 wherein the lift cord control mechanism is comprised of at least one of a spring motor unit and a motor unit.

15. The window covering of claim 1 wherein each of the cord shrouds is bonded to the window covering material via welding such that at least one continuous welding joint formed from welding the cord shroud to the window covering material defines the at least one line that extends from adjacent the upper portion of the window covering material to adjacent the lower portion of the window covering material.

16. The window covering of claim 1 wherein each of the cord shrouds covers at least one of the lift cords such that the cord shroud encloses that at least one lift cord.

17. The window covering of claim 1 wherein each of the cord shrouds extends from adjacent the upper rail by having a top portion positioned on the upper portion of the window covering material.

18. The window covering of claim 1 wherein each of the lift cords is comprised of a strip of material.

19. The window covering of claim 1 wherein a portion of the first lift cord and a portion of the second lift cord are located within the upper rail.

* * * * *